United States Patent [19]

Ragheb

[11] 4,296,394

[45] Oct. 20, 1981

[54] MAGNETIC SWITCHING DEVICE FOR CONTACT-DEPENDENT AND CONTACTLESS SWITCHING

[76] Inventor: A. Kadry Ragheb, 100 François, Montreal, Quebec, Canada

[21] Appl. No.: 870,846

[22] Filed: Feb. 13, 1978

[51] Int. Cl.[3] ..... H01H 36/00

[52] U.S. Cl. ..... 335/207; 335/205; 335/206; 200/67 F

[58] Field of Search ..... 200/67 F; 335/207, 205, 335/306, 206

[56] References Cited

U.S. PATENT DOCUMENTS

| | | | |
|---|---|---|---|
| 2,951,129 | 8/1960 | Mink | 200/67 F |
| 3,052,778 | 9/1962 | Kathe | 335/207 |
| 3,055,999 | 9/1962 | Lucas | 200/67 F |
| 3,056,000 | 9/1962 | Lucas | 200/67 F |
| 3,065,366 | 11/1962 | Speiser et al. | 310/15 |
| 3,194,912 | 7/1965 | Mink | 335/207 |
| 3,243,543 | 3/1966 | Maxwell | 335/207 |
| 3,703,695 | 11/1972 | Mogi | 335/207 |
| 3,854,109 | 12/1974 | Gotanda | 335/306 |

*Primary Examiner*—Harold Broome

*Attorney, Agent, or Firm*—Hughes, Barnard & Cassidy

[57] ABSTRACT

A magnetic switching device comprising a drive member and a slave member having magnetically attractive surfaces, the two members move angularly with respect to one another so as to bring the magnetic surfaces in and out of contact with one another.

72 Claims, 30 Drawing Figures

MAGNETIC SWITCHING DEVICE FOR CONTACT-DEPENDENT AND CONTACTLESS SWITCHING

The present invention relates broadly to switching devices and, more particularly to contact-dependent switching devices used in electrical circuits. The invention further relates to the actuation of solid-state sensors in contactless electronic switching devices. Further applications relate to the actuation of flow-restricting valves in pneumatic and hydraulic control devices. This invention also relates to pressure-sensitive mechanical triggering devices and release mechanisms.

The actuation of the switching device of this invention is based on the manipulation and arrangement of movable magnetic members, and it requires the application of an actuating force, either manually, mechanically or electro-mechanically.

An object of this invention is to provide a switching device producing a snap-action movement.

A second object is to provide a switching device producing a slow-acting movement, for applications in pneumatic and hydraulic control devices.

A third object is to provide a switching device with a combined, sequential, slow-acting/snap-acting movement.

A fourth object is to provide a switching device with momentary actuation.

A fifth object is to provide a switching device with bi-stable actuation,

A sixth object is to provide a pressure-sensitive tripping or triggering device.

Further objects of this invention are to provide some of the preceding switching devices with different modes of actuation, such as push-button; rotary actuation; slide actuation; and rocker and toggle actuation.

Subsequent objects and advantages such as those pertaining to the simultaneous switching of a multitude of contacts, will become apparent in more detail in the ensuing explanation of the annexed drawings and specification.

The switching device of the present invention comprises: at least one driver member, guide means supporting and adapted to guide the driver member for free movement in a predetermined path, at least one movable slave member provided with a pivot and having at least one free end, pivot means cooperating with the slave member and adapted to support and guide the slave member for free pivotal movement between a first magnetically locked position and a second actuated position, magnetic elements having predominant magnetic surfaces are respectively arranged on the driver member and on the slave member, with at least one of the magnetic elements being a permanent magnet, with the driver member and the slave member arranged in combination, the respective magnetic surfaces are arranged with respect to each other so that they face and overlie each other to the extent that a magnetic locking action holds the slave member in a first locked position against the magnetic surface of the driver member, Bearing means on the driver member arranged to be moved into position to make contact with a cooperating position on the slave member, the cooperating position being chosen with respect to the pivot of the slave member in such manner as to allow the application of a preselected actuating leverage, with the bearing means on the driver member in contact with a preselected position on the slave member, an actuating force applied to the driver member is transferred through the bearing means to the slave member, as the driver member is moved in the predetermined path the slave member is pivoted from the first magnetically locked position to the second actuated position, with the slave member in the second position the magnetic force of attraction being sufficient to reverse the movement of of the slave member and the driver member.

Other embodiments of this invention provide a bi-stable movement, wherein the slave member is retained in its second position on the removal of the actuating force by controllable retaining means which prevent the free reversal of the movement of the slave member and the driver member as a result of the magnetic attraction between their magnetic surfaces.

Implemented in the embodiments of this invention are snap-action movements and slow-actuation movements, in which the speed of the movement refers to the travel of the slave member between two positions. The difference between the two movements lies on the amount of preselected leverage exerted by the driver member's bearing means onto the bearing surface of the slave member at the moment of transfer of the actuating force. The location of the bearing surface on the slave member, taken with respect to the slave member's pivot, and measured radially along the slave member or on an extension arm thereof, predetermines the amount of desired leverage, in combination with an actuating force. The longer the said radial distance is chosen, the slower the movement of the slave member within its path. A snap-action movement as intended in this invention is one in which the movement of the slave member can neither be halted half way in its path, nor can it be allowed to reverse itself, once actuation has been initiated.

Unlike other magnetic switching devices affording limited modes of actuation, this device, because of its simplicity of construction and assembly, may be arranged for a choice of modes of actuation: push-button; slide-actuation; rotary actuation; and toggle or rocker actuation. In one embodiment of a group of rotary-type of actuation, the movable magnetic members are arranged in a manner as to produce a snap-action, sequentially actuated set of multiple contacts, each such set of contacts progressively held in a locked, actuated position.

Examples of previously known magnetic switches are included in U.S. Pat. No. 3,055,999 to A. R. Lucas; U.S. Pat. No. 2,951,129 to D. H. Mink; and U.S. Pat. No. 3,052,778 to E. A. Kathe. The problem of arcing is invariably present in the hesitation movement produced as a result of applying the actuating force directly onto the contact-making/breaking member, such as presented by D. H. Mink. The same hesitation is present in the transitional rocking movement of the contact-making/breaking member in E. A. Kathe's version. In Lucas, as stated in his presentation, his switching device is limited for use on low voltage circuits where the current flow is relatively small. This limitation is obvious in the arrangement of the resilient conductor with respect to the adjacent movable magnet member; a high current passing through the said conductor would demagnetize the said magnet.

With reference to solid-state switching, solid-state sensors dependent on manual, mechanical or electro-mechanical actuation, including Piezo-crystals, Opto-electronic sensors, Hall generators and Magneto-resistive sensors, all require a reliable actuating device. Because most of these sensors are triggered silently, their installation requires the addition of a means confirming actuation, such as optical feedback signals or control lamps. This is particularly the case with Piezo-electric sensors requiring imperceptible atuatig movements. With reference to this invention, the combination of a simultaneous snap-action movement with a solid-state switching sensor provides a tactile and/or audible confirmation of actuation. In addition, the contact-making/breaking capabilities of this switching movement would provide a snap-action actuation of independent electrical circuits, while actuating solid-state sensors, simultaneously.

Permanent magnets used in the present invention may be of any shape, size and composition. The choice of magnetic properties is not limited to powerful magnets. Embodiments of this invention emphasizing miniaturization employ techniques known to those skilled in the art, such as the concentration of magnetic flux in small areas in so-called magnetic-sandwich and other loudspeaker-cup assemblies. The use of ferrous pole-pieces to extend or divert a magnetic pole has been employed in yet another assembly relating to a tripping or triggering device.

In drawings which illustrate embodiments of this invention, FIGS. 1 to 13 represent diagramatic views of basic modes of actuation of this switching device, which produce momentary actuation. FIGS. 14 to 18 represent views of embodiments which produce bi-stable actuation. FIGS. 19 to 30 represent views of embodiments with special applications. Referring to the list of drawings, FIGS. 1 and 2 represent in diagramatic form a basic embodiment of a momentary actuation type of switch, wherein both movable members are moved radially, in counter rotation with respect to each other. FIG. 2 shows the same embodiment in the actuated mode.

FIG. 5 shows the actuated mode.

FIG. 7 shows the actuated mode.

FIG. 9 shows the device in the actuated mode.

FIG. 11 shows the device in the actuated mode.

Figure 12:
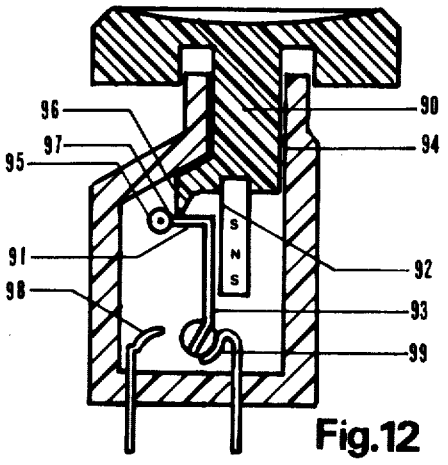
Figure 13:
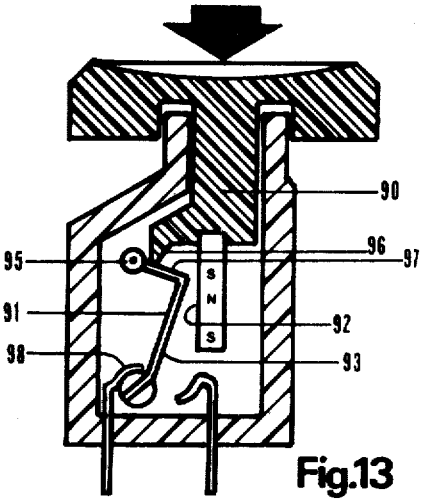

FIGS. 12 and 13 represent in diagrammatic form a further embodiment of a momentary actuation type of switch, wherein the driver member is supported and guided to be moved in a sliding motion, in a direction generally parallel to the locked magnetic surfaces, and wherein the slave member is pivoted away when an actuating force is transmitted onto it. FIG. 13 represents the switch in the actuated mode.

Figure 1:
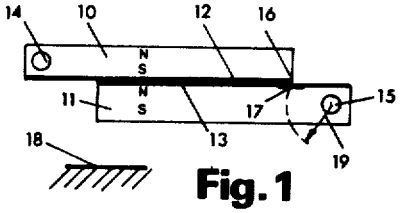
Figure 2:
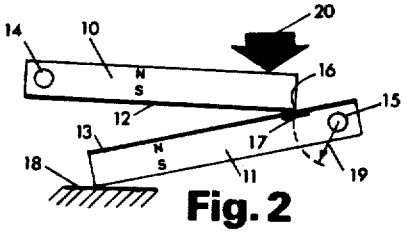
Figure 14:
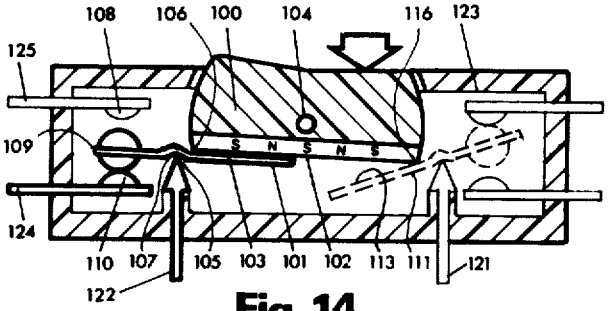
Figure 15:
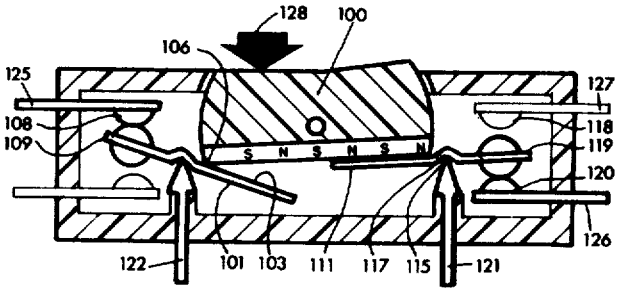

FIG. 14 represents in diagrammatic form a portion of a bi-stable movement, based on the pivotal movement outlined in FIGS. 1 and 2, with the addition of a second pivoted slave member. FIG. 15 shows the completed bi-stable switch.

Figure 8:
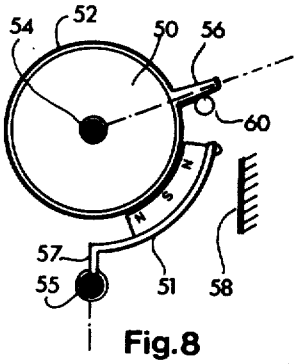
FIGS. 8 and 9 represent in diagrammatic form a further embodiment of a momentary actuation type of switch, with a rotational movement, wherein both movable members have curved surfaces arranged concentrically with respect to each other.
Figure 9:
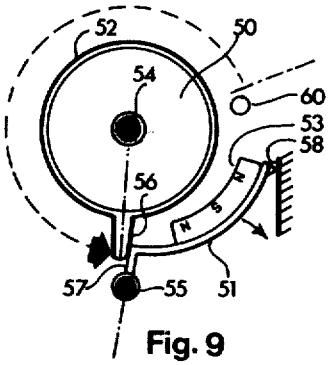
Figure 16:
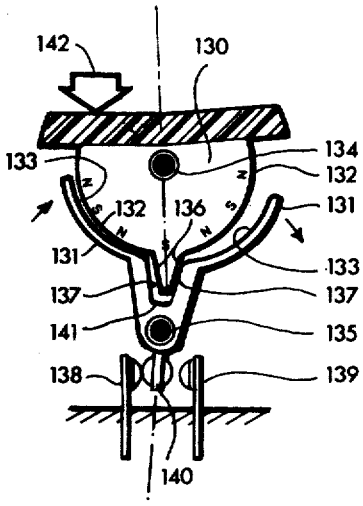

FIG. 16 represents in diagrammatic form a bi-stable version of the embodiment with rotational movement represented in FIGS. 8 and 9. The movement is snap-action.

Figure 17:
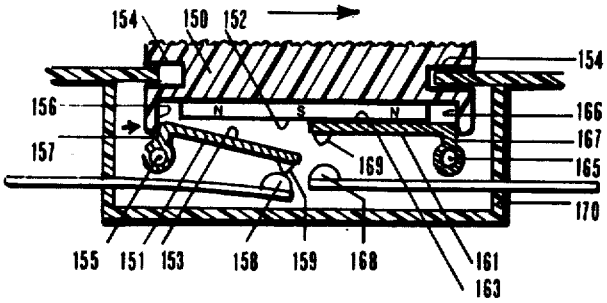

FIG. 17 represents in diagrammatic form another embodiment of a bi-stable swithing device, based on the sliding motion represented in FIGS. 12 and 13, with the addition of a second pivoting slave member.

Figure 18:
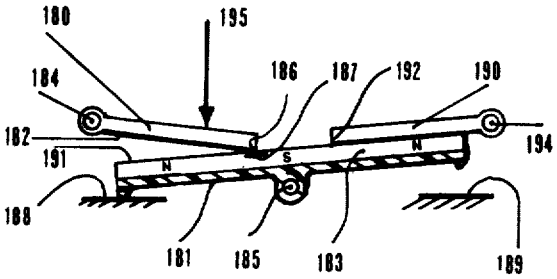

FIG. 18 represents in diagrammatic form a further embodiment of a bi-stable movement, based on the basic movement represented in FIGS. 1 and 2, with only one slave member and two pivoting driver members.

Figure 19:
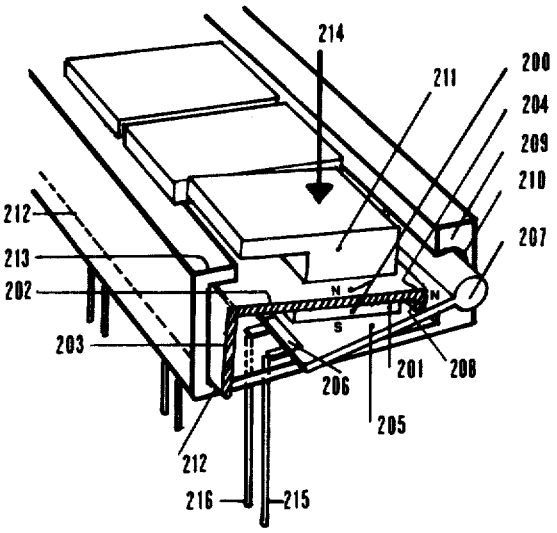

FIG. 19 is a perspective view of an embodiment of this invention, showing a different magnet assembly, using the cup-magnet construction. The housing is shown as being a portion of a continuously extruded plastic channel, with a cavity to receive a hinged slave member.

Figure 20:
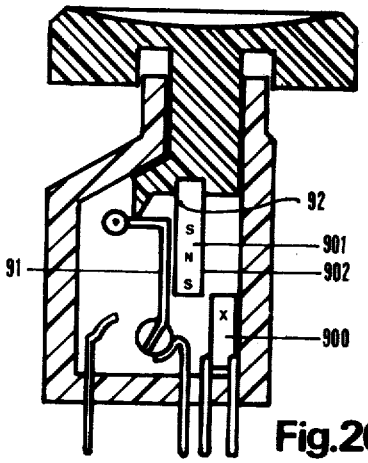
Figure 21:
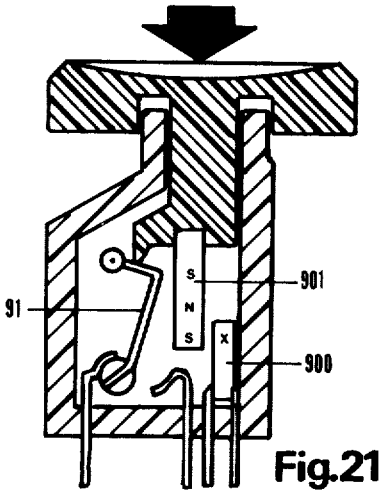

FIGS. 20 and 21 are diagrammatic sectional views of an embodiment of this invention, representing a contact-dependent, momentary, snap-action switch, adapted to actuate a contactless solid-state sensor. The sensor may be any one of those dependent on magnets for actuation, such as Hall-generators and magneto-resistive sensors. The same type of combined assembly may be adapted to control the continuity of a light beam with respect to an associated Opto-electronic sensor, placed within the same housing. The tactile and/or audible signal produced by the snap-action adds a confirming feedback to the silent actuation of a solid-state sensor. In this type of assembly, the timing of the snap action may be made to coincide with the actuatuation of the solid-state sensor. FIG. 21 shows the switch, actuated.

Figure 22:
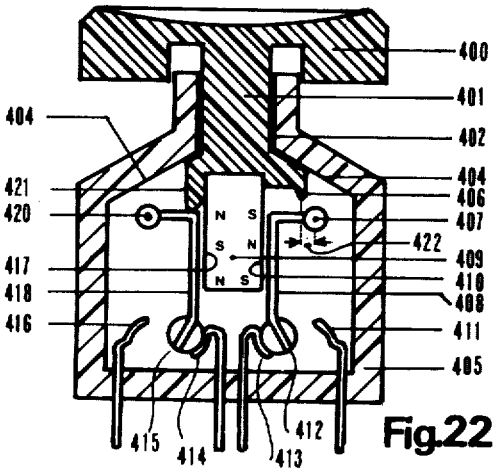
Figure 23:
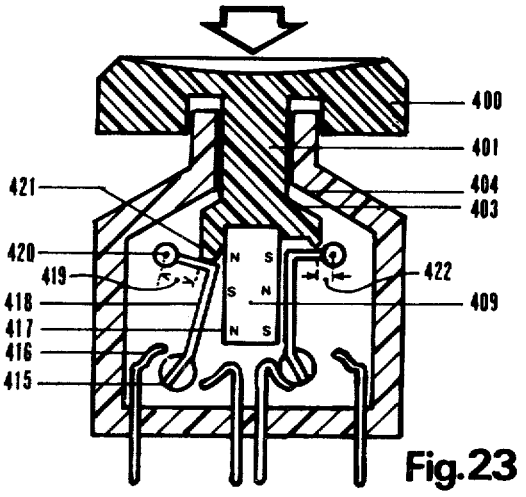

FIGS. 22 and 23 are diagrammatic sectional views of another embodiment, representing a snap-action switch with pre-travel motion. This is essentially a combination of two movements in sequence, based on the snap-action version of the switch described in FIG. 12 in combination with an added slave member. In two slave members are arranged with respect to the plunger-type driver member so as to be actuated at succeeding intervals, by respective bearing means, making contact with each slave member at a different location with respect to that slave member's pivot. A similar assembly may be arranged to actuate a multitude of slave members, either in sequence or simultaneously, when such slave members are grouped around a common driver member.

Figure 24:
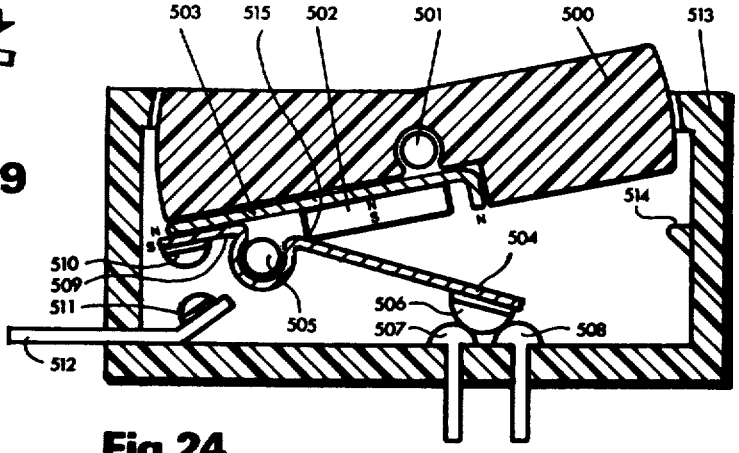

FIG. 24 is a diagrammatic sectional view of an embodiment representing a snap-action, pressure sensitive triggering switch. It is a bi-stable switch utilizing only one magnet member, and retained in the cocked position by the magnetic short-circuiting position of the slave member, with respect to an extended polepiece of the magnet member. In other words, the slave member makes contact with the North and the South pole of a magnet member simultaneously to form a stable holding position. In the other stable position, the slave member makes contact with only one pole, on the surface of the magnet facing said slave member.

Figure 25:
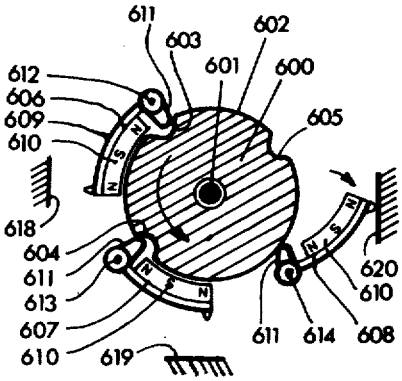

FIG. 25 represents a diagrammatic view of a snap-action switch of this invention with rotary actuation. It shows a multitude of slave members which can be actuated according to a pre-programmed sequence. The circular driver member performs the function of a cam, with respect to the pivoting slave members.

FIGS. 26, 27, 28 and 29 are diagrammatic sectional views of an embodiment of this invention, representing a toggle switch with 4 positions: two central, bi-stable positions, flanked by one momentary position on each side.

Figure 30:
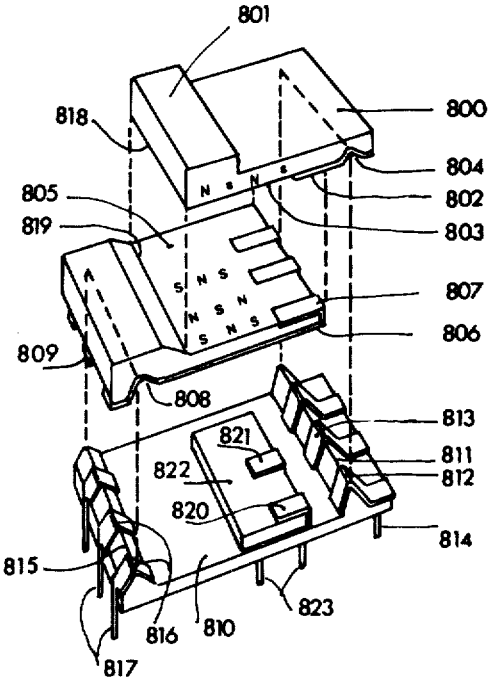

FIG. 30 is an exploded view of an embodiment representing a momentary, snap-action switch, actuating a multitude of contacts, simultaneously, with double-throw actuation.

The choice of magnetization of the permanent magnets employed in embodiments of this invention may be a simple pair of North and South poles, arranged on opposite surfaces of the magnet. A magnet may also have a multitude of alternating North and South poles, arranged on the same surface of the magnet or on opposite surfaces. In other embodiments, the periphery of a ring-magnet, or a segment thereof would be provided with a multitude of magnetic poles.

Because of the poor conductivity of the ceramic and plastic-bonded type of magnets, they may be moulded, incorporating integral parts such as conducting strips, ribbon contacts and electric shunt pieces, as well as applicable shafts, bushings, pivot pins and other parts that would otherwise require separate assemblies.

Referring to the drawings, FIGS. 1 and 2 represent one embodiment of the present invention wwherein a driver member 10 is provided with a magnetic element 12, having a proportionately large magnetic surface, and allowed free movement, in a predetermined path, around a fixed pivot 14 and operatively arranged in combination with a slave member 11, provided with a magnetic element 13, having a proportionately large magnetic surface, and allowed free pivotal movement around fixed pivot 15 in a predetermined path, between a first locked position and an actuated position, defined by a limiting stop 18. The driver member 10 and the slave member 11 are arranged with respect to each other in such manner that the respective surfaces of the magnetic elements 12 and 13 are made to face each other and overlie each other to the extent that a magnetic lock, created by the magnetic attraction between the magnetic surfaces of elements 12 and 13, holds the driver member 10 and the slave member 11 in a firm, locked position. This position defines the slave member's first locked position. The driver member 10 is provided with a bearing edge 16 which faces a corresponding bearing surface 17 on the slave member 11. The location of the bearing surface 17 is chosen with respect to the slave member's pivot 15 in such manner as to allow the application of a predetermined actuating leverage. An actuating force 20, applied to the driver member 10 will cause the latter to move towards the slave member 11 and will allow the bearing edge 16 to make contact with the bearing surface 17. Such contact will allow the force 20 to be transmitted through bearing edge 16, onto bearing surface 17, causing the magnetic lock holding the slave member in its first position to weaken sufficiently to allow the slave member 11 to be pivoted away, in its predetermined path, to its second, actuated position, defined by limiting stop 18. The location of the bearing surface 17 is defined by its radial distance 19 as measured from the slave members pivot 15, and taken at the moment of transfer of the actuating force onto the said bearing surface 17. The larger the distance 19 the slower the movement of the slave member 11 within its predetermined path. As indicated in FIGS. 1 and 2, distance 19 being chosen relatively small, the applied force 20 produces a snap-action movement of the slave member 11, as indicated in FIG. 2. Limiting position 18 may be either a fixed or a resilient member, or an appropriate portion of an electric contact member. The location of limiting position 18 must be chosen to limit the movement of the slave member 11 to well within the magnetic field of attraction between the magnetic elements 12 and 13, in order to enable said magnetic attraction to restore the slave member 11 and the driver member 10 to their starting positions, once the actuating force is removed. This reverse movement occurs when the attracting magnetic force is transmitted, from the slave member 11 being in motion, through the the slave member's bearing surface 17, onto the driver member's bearing edge 16, thus forcing the driver member 10 to move back to its starting position, followed by the simultaneous movement of the slave member 11 to its first locked position. The amount of magnetic attraction between the magnetic elements 12 and 13 is in direct proportion to tthe areas of their overlying magnetic surfaces when these are facing each other. But said magnetic attraction diminishes proportionately with distance, as the magnetic members 12 and 13 get separated by an air gap.

Figure 3:
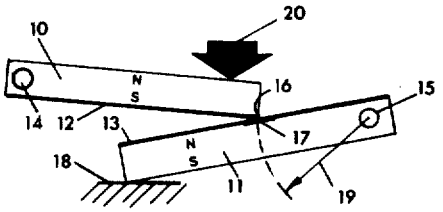
FIG. 3 represents essentially the same embodiment of FIGS. 1 and 2, with particular stress on the location of the bearing surface of the slave member with respect to its pivot, to produce slow actuation in contrast to snap-action.

FIG. 3 illustrates basically the arrangement of driver member 10 and slave member 11 shown in FIG. 2, except that the switching device, as illustrated, denotes a slow-acting movement, in contrast to a snap-action movement, as shown in FIG. 2. The radial distance 19, in FIG. 3, measured between the slave member's pivot 15 and the relocated bearing surface 17, has been increased. In the resulting slow mode of actuation, in contrast to a snap-action, the movement of the slave member 11 may be halted or reversed before said slave member 11 is allowed to reach its limiting position 18. A slow actuation of the kind described gives the tactile feeling of actuating a resilient member.

In FIGS. 1, 2 and 3, as well as in all embodiments of this invention, except where noted, either of the magnetic elements can be, but at least one must be a permanent magnet. The counterpart magnetic element can be either another permanent magnet or a strip or plate of a magnetic material such as soft iron, a ferrous alloy, a nickel alloy or equivalents. When two permanent magnets are chosen for a face-to-face arrangement, the choice of magnetic poles on both magnets should be such that unlike magnetic poles face each other, to produce magnetic attraction between the permanent magnets.

Figure 4:
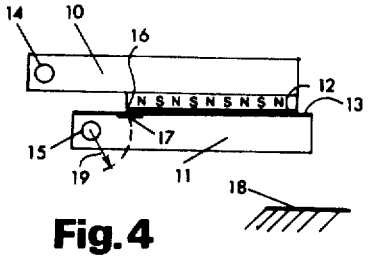
FIGS. 4 and 5 represent in diagrammatic form a further embodiment of a momentary actuation type of switch, wherein both movable members are moved pivotally, in the same rotational direction with respect to each other.
Figure 5:
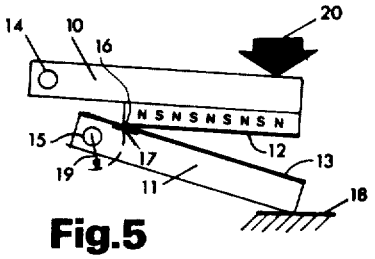

FIGS. 4 & 5 illustrate an embodiment in which a momentary actuation is produced. Essentially the same movable members described in FIGS. 1, 2 and 3 are used, except that the fixed pivots 14 and 15, supporting and guiding driver member 10 and slave member 11 are located on one and the same side of the switch, an actuating force 20, bearing down onto the driver member 10 causes said member 10 to be moved within its guided predetermined path around pivot 14 in a direction towards slave member 11. Said movement causes the actuating force 20 to be transmitted, via the bearing edge 16 of the driver member 10, onto the bearing surface 17 of the slave member 11, further causing the said slave member to be pivoted away from its first locked position, in a downward direction, within its guided path, to its second actuated position defined by limiting position 18. Said position 18 is chosen so as not to exceed the range of magnetic attraction between the respective magnetic surfaces of the magnetic elements 12 and 13 which form part of the driver member 10 and the slave member 11 respectively. The radial distance 19, measured between the slave member's pivot 15 and its bearing surface 17, determines the actuating characteristic of the switching device, whether snap-action or slow moving. The speed of movement referring to the movement of the slave member within its guided path. When the actuating force 20 is removed, the magnetic attraction between the magnetic members causes the slave member 11 to be moved towards the driver member 10. Said reverse movement causes the bearing surface 17 of the slave member 11 to bear against the bearing edge 16 of the driver member 10. In effect, the slave member 11 in its reverse motion pushes the driver member 10 ahead of it, both said members moving simultaneously until they reach their respective initial positions, wherein the slave member 11 is in its first locked position. FIG. 5 shows the switching device in the actuated mode.

Figure 6:
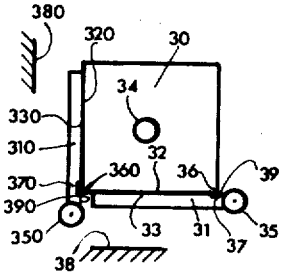
FIGS. 6 and 7 represent in diagrammatic form a basic embodiment of a momentary actuation type switch, wherein the rotational movement of the driver member actuates more than one slave member, simultaneously.
Figure 7:
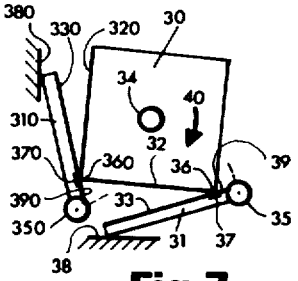

FIGS. 6 and 7 show another embodiment with momentary actuation wherein a driver member 30 made of a magnetic material is provided with two magnetic surfaces 32 and 320 angled with respect to each other. Surface 32 is provided with a bearing edge 36 and surface 320 is provided with a bearing edge 360, the latter located at the corner forming the angle between the surfaces 32 and 320. A fixed pivot 34 supports and provides guided pivotal movement for driver member 30 within a predetermined path. Pivot 34 is generally located inside the angle formed by surfaces 32 and 320. A first slave member 31 and a second slave member 310 respectively provided with magnetic elements 33 and 330 having proportionately large magnetic surfaces. Fixed pivots 35 and 350 providing support and guided free movement for the slave members 31 and 310 respectively. Slave members 31 and 310 are each provided with a bearing surface, indicated as 37 and 370 respectively and located along the respective magnetic surfaces of magnetic elements 33 and 330, at a location adjacent to the respective pivots 35 and 350. The driver member 30 and the slave members 31 and 310 are arranged with respect to each other so that their respective magnetic surfaces face each other and overlie each other to the extent that a magnetic lock created by magnetic attraction holds slave members 31 and 310 firmly against the respective magnetic surfaces 32 and 320 of the driver member 30. Pivots 35 and 350 are arranged to be beyond the reach of bearing edges 36 and 360 of the driver member 30. Radial distances 39 and 390 are chosen to control the respective appropriate movement of the respective slave members 31 and 310, as a snap-action or as a slow movement actuation. Limiting stops 38 and 380 define the second actuated position of the respective slave members 31 and 310. The actuation of the device is by applying a clockwise rotational force 40 to the driver member 30. This device is not limited to only two slave members.

FIGS. 8 and 9 represent an embodiment of a rotary switch with momentary actuation, allowing for rotation over a large portion of a circle before actuation takes place. In FIG. 8, a fixed pivot 54 allows free guided movement for a cylindrically shaped driver member 50 having an outer mantel 52 made of a ferrous material. A protrusion, forming a fixed part of the driver member 50, and extending beyond the periphery of the mantel 52, is provided with a bearing edge 56. A permanent magnet member in the shape of a segment, having an inside periphery conforming to the outside periphery of the mantel 52, is magnetized on its surface 53 facing said mantel 52. Said permanent magnet is fixed to a slave member 51 having an angled portion provided with a bearing surface 57 and terminating at fixed pivot 55 which provides said driver member 51 with free pivotal movement between a first locked position, and a second actuated position indicated at limiting position 58. The protrusion with its bearing edge 56 may be freely rotated without disturbing the magnetically locked slave member 51, at the latter's first position, as indicated in FIG. 8. When the driver member 50 is rotated counter clockwise until the said protrusion makes contact with the slave member 51, an additional force will cause the bearing edge 56 to bear onto the slave member's bearing surface 57, causing said slave member to pivot away, from its first locked position, to its second actuated position at the limiting position 58. When the said additional force is removed, the magnetic attraction will return the slave member 51 to its first locked position and the bearing surface 57 will bear against bearing edge 56, causing the said protrusion to return to its position at the moment of first contact with the slave member 51. FIG. 9 represents the switch when the slave member is actuated. Limiting pin 60 acts as a stop for the said protrusion when the driver member is rotated clockwise. This embodiment is not limited to only one slave member.

Figure 10:
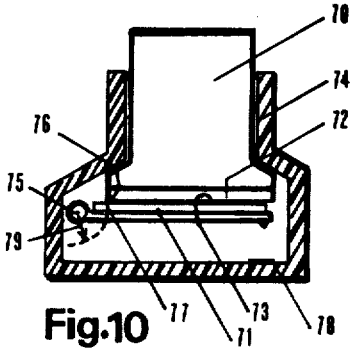
FIGS. 10 and 11 represent another embodiment of the momentary, push-button type, wherein the driver member is supported and guided for linear movement and bears onto a slave member guided for pivotal movement.
Figure 11:
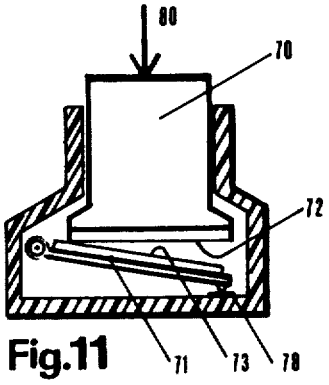

FIGS. 10 and 11 represent yet another momentary switch, with push-button actuation. It differs from the switches shown in FIGS. 1 to 9, in that the driver member is moved linearly like a plunger to actuate a pivoting member. The Figures represent diagrammatically a housing with an opening, providing support and guiding tracks 74 allowing free linear movement, within a predetermined path, for a driver member 70, being provided with a strip or plate, made of a ferrous material, and having a proportionately large surface 72. The driver member 70 is further provided with a bearing edge 76. A slave member 71, arranged for free pivotal movement around a a fixed pivot 75, is provided with a permanent magnet member having a proportionately large magnetic surface 73. The driver member 70 and the slave member 71 are arranged with respect to each other so that the magnetic surface 73 of the magnet overlies the bottom surface 72 of the driver member's ferrous plate or strip to the extent of forming a magnetic lock between the surfaces 72 and 73. When an actuating force 80 moves the driver member downwards, the bearing edge 76 bears down onto a corresponding bearing surface 77, located on the slave member 71, causing the latter to be pivoted away from its first locked position to its second actuated position, limited by stop 78, as shown in FIG. 11. Distance 79, measured radially from the slave member's pivot 75, being shown relatively small in the drawings, indicates that the switch assembly produces a snap-action movement. When the actuating force 80 is removed, the magnetic attraction causes the return of the slave member 71 and the driver member 70 to their original position, as indicated in FIG. 10.

FIGS. 12 and 13 represent yet another push button switch, with a sliding movement which has similarities with the movement shown in FIGS. 8 and 9, except that the rotary movement of the driver member is replaced here by a linear movement. In the diagrams of FIGS. 12 and 13, guiding tracks 94, along an opening of a housing, allow free movement of a driver member 90, in a predetermined vertical path. The driver member 90 is provided with a permanent magnet member, protruding downwardly from the base of said driver member 90, and arranged to have a magnetic surface 92 with a proportionately large area oriented so that it faces away from the switch's housing. The driver member is further provided at its base with a bearing edge 96. A slave member 91 is provided with a bearing surface 97, at its pivoted end, and an angled portion providing a relatively large surface 93 extending to its free end. Said slave member is arranged to be moved freely around fixed pivot 95, and further arranged so that its surface 93 faces surface 92 of the magnet member and overlies it. Slave member 91 being made of a ferrous material will be magnetically attracted to the driver member's permanent magnet along its surface 92 and remain held firmly in this first locked position. A fixed stop 99, at the base of the housing provides a first limiting position at the free end of the driver member 91, allowing for a small air gap between surfaces 92 and 93. Said air gap allows for frictionless movement of the driver member 90 as well as provides a good pressure contact between the free end of of the slave member 91 and the first limiting stop 99. A downward push of the driver member 90 causes its bearing edge 96 to bear onto bearing surface 97, further causing the slave member 91 to break its magnetic lock with the permanent magnet as well as separating from the first limiting stop 99 and pivot away to its second, actuated position, defined by limiting stop 98, as shown in FIG. 13. When the downward push on the driver member 90 is released, magnetic attraction causes the slave member 91 to swing back freely to its first locked position and causes it bearing surface 97 to push the driver member 90, through the latter's bearing edge 96, vertically upwards to the upper limit of its predetermined path.

An embodiment of a bistable switch is shown in FIGS. 14 & 15 and is based on the basic movement described in FIGS. 1 and 2. The assembly shown in FIG. 14, a housing 123 is provided with an opening to accomodate an actuating knob of a driver member 100 allowed free pivotal movement around a fixed pivot 104. A permanent magnet with a large magnetic surface 102, terminating on one side with a bearing edge 106 and on the other side with a bearing edge 116, is fixed to the bottom surface of the pivoting knob of driver member 100. A slave member 101, made of a flat strip of a ferrous material is provided with a notch 107 which serves as a pivot edge in combination with a fixed poined edge 105 of a conductor member 122 integrally moulded at the base of housing 123. The notch 107 provides slave member 101 with two free ends, one of which with a large surface 103 is arranged with respect to the magnet member so that it makes contact with a relatively large area of surface 102 of said magnet member. The other free end of said slave member 101 is provided with a dual contact-making member 109 arranged to make a pressure contact with an appropriate contact 110 of a fixed terminal 124. The bearing edge 106 of the permanent magnet operates in combination with a predetermined bearing surface on surface 103 of slave member 101, adjacent to its notch 107. The assembly and disposition of the driver member 100 in combination with a single movable slave member 101, as described in FIG. 14 shows a switching device with momentary actuation. So that, when an actuating force 128, as indicated in FIG. 15, is applied to the knob of driver member 100, to the left side of pivot 104, bearing edge 106 causes slave member 101 to break the magnetic lock attracting surfaces 102 and 103 to each other, and slave member 101 is pivoted away from its first locked position to its second, actuated position where dual contact-making member 109 makes pressure contact with contact 108, forming part of terminal 125. In order to retain slave member in its second, actuated position after the removal of actuating force 128, magnetic retaining means are introduced in the assembly. As indicated in dotted line in FIG. 14 and in solid line in FIG. 15, a second slave member 111, provided with an appropriate notch 117, is arranged for free pivotal movement atop poited edge 115 and further arranged to have a large portion of its surface 113 in overlying contact with a large area of the surface 102 of the permanent magnet. Slave member 111, being chosen of a ferrous material, will be magnetically locked against the permanent magnet's surface 102 to the extent that both driver member 100 and second slave member 111 will remain in this stable position, as shown in FIG. 15, even after the removal of the actuating force 128. This stable position simultaneously maintains slave member 101 in its actuated position, as shown in FIG. 15. An actuating force applied to the right side of the driver member's pivot will produce the second bi-stable position. Associated contact 119 cooperates with contacts 120 and 118 of terminals 126 and 127 respectively in alternating actuated positions of this bi-stable double pole, double throw switching device. In both FIGS. 14 and 15, bearing edge 116 associated with driver member 100 cooperates with slave member 111 much the same as bearing edge 106 cooperates with slave member 101. FIG. 16 shows another switch assembly with bi-stable actuation, based on the rotary movement of the momentary switch represented in FIGS. 8 and 9. In FIG. 16, a segment of a round permanent magnet, with a central hole and magnetized on its curved periphery 132, is fixed onto the bottom surface of a manually operated knob, the combination comprising the driver member 130, arranged for free pivotal movement around a fixed pivot 134, coinciding with the permanent magnet's central hole. A protrusion, forming part of the driver member 130 and extending beyond the magnet member's peripheral surface 132, is provided with bearing edges 136. A slave membver 131, made of a magnetic material such as ferrous metal, and generally horse-shoe shaped with spread jaws, is provided with a notch 141 at its base, and arranged for free pivotal movement around fixed pivot 135, the latter being located at a point on the base of the slave member 131, below the notch 139. An extension arm, forming a fixed part of the slave member 131, extends beyond pivot 135 and is provided at its free end with dual contact-making member 140. The inside walls of the slave member 131 are predeterminedly spaced apart and provided with bearing surfaces 137. The inside surfaces 133 of the slave member's jaws are preferably curved for maximum magnetic attraction, with curvatures conforming to the circular periphery 132 of the permanent magnet. The driver member 130 and the slave member 131 are arranged with respect to each other in such manner as to have only one of the the slave member's jaws magnetically locked to the permanent magnet's periphery 132 at any one time. By arranging the slave member's bearing surfaces 137 to be within the reach of the bearing edges 136 of the driver member's protrusion, either of said bearing edges 136 may be brought to make contact with a corresponding bearing surface 137 inside the slave member's notch, without disturbing the magnetically locked slave member 131. In order to cause the actuation of the switch, an actuating force 142, must cause a bearing edge 136 of the driver member's protrusion to bear onto a corresponding bearing surface 137, forming the magnetic lock between adjacent surfaces 132 and 133 to be sufficiently weakened thereby allowing the slave member 131 to be pivoted, in a snap movement, bringing the other jaw into a magnetically locked position. Applying an actuating force on the opposing side of the knob will cause the slave member to snap to its other locked position. The spread between the bearing surfaces 137 of the slave member's notch determines the amount of pre-travel allowed to the rocker movement of the actuating knob, before either of the snap movements of the slave member 131 is initiated. Fixed limiting stops 138,139 flanking the slave member's contact-making member 140 are preferably spaced apart in such manner as to produce a presure contact between contact member 140 and each of said limiting stops, or contacts 138 & 139, alternatively. As indicated in FIG. 16, the limiting contact 138 is arranged to bear against contact member 140, causing the slave member's left jaw to allow a small air gap to form between the magnetically locked surfaces 132 and 133. This bi-stable switch eliminates all teasing between contacts.

The basic movement producing momentary actuation in the switch shown in FIGS. 12 and 13 is used to produce bi-stable actuation in the embodiment shown in FIG. 17, which represents a snap-action slide-switch, wherein a housing of non-magnetic material 170, having an opening at its top, provides support and guided linear movement for a driver member 150, comprising an actuating knob provided with guiding tracks 154, allowing said driver member 150 a linear sliding movement within the predetermined opening of housing 170. Said actuating knob of driver member 150 is provided with a textured surface on its top and with a cavity on its bottom portion accomodating a fixedly arranged permanent magnet having a proportionately large magnetic surface 152. Bearing surfaces 156 and 166 are provided on the inside rim of the cavity forming the bottom of driver member 150. Said bearing surfaces 156 and 166 are arranged to be protruding beyond the permanent magnet's surface 152. Slave members 151 and 161, both made of a ferrous material and generally L-shaped, provide bearing surfaces 157 and 167, respectively, on the short portion of their lengths, terminating at fixed pivots 155 and 165, respectively. Slave members 151 and 161, being arranged for free pivotal movement around their respective fixed pivots 155 and 165, within predetermined paths. Driver member 150 and slave members 151 and 161 are arranged with respect to each other so that when slave member 161 is in its fist locked position, with the larger portion of its length overlying, and its surface 163 in contact with, the permanent magnet's surface 162, said slave member 161 will have its bearing surface 167 in contact with the bearing surface 166 of the rim of the driver member's cavity. Concurrently, slave member 151 will be in its second, acuated position, where a conducting member at its free end 159 is operatively engaged with limiting contact 158. Said slave member 151 is retained in its second actuated position by the bearing force exerted on its bearing surface 157 by bearing surface 156 of the driver member's cavity rim. Sliding the driver member along its guiding tracks 154 to the left, to the limit of its path, will cause the bearing surfaces 156 and 166 to react onto slave members 151 and 161, causing the reversal of their respective positions with a snap—action movement, so that slave member 161 will be moved to its second, actuated position, wherein contacts 169 and 168 become operatively engaged, whereas concurrently, slave member 151 is allowed to pivot freely to a fist locked position, where the larger portion of its length 153 is magnetically attracted to the permanent magnet's surface 152.

FIG. 18 represents yet another switch with a bi-stable movement, based on FIGS. 1 and 2. In FIG. 18 two driver members 180 and 190 are operatively arranged to cooperate with single slave member 181, pivotally arranged for free movement around pivot 185. While this disposition of the movable members with respect to each other has similarities with the embodiment shown in FIGS. 14 and 15 it is not an inverted version of it. The embodiment represented in FIG. 18 comprises a first driver member 180, made of a magnetic material such as soft iron, having a pivoted end at 184, and subjected to a force 195 which is then transmitted through a bearing edge 186 onto a bearing surface 187 of a magnet member 183, the latter being fixedly supported by a slave member 181, arranged for free pivotal movement midway along its length, around fixed pivot 185. Said actuating force 195 causes slave member 181 to be pivoted counter-clockwise, onto a limiting stop 188, designating the slave member's second actuated position. In order to retain slave member 181 in said position after the removal of Force 195, a second driver member 190 is introduced into the assembly. Made of the same magnetic material as the first driver member 180, said second driver member 190 is arranged to lock magnetically onto surface 191 of magnet member 183, in a surface-to-surface contact, and further arranged to be restrained in this locked position by a fixed pivot 194, at a pivoted end of said locked second driver member 190, as indicated in FIG. 18. When another actuating force is applied onto driver member 190, the process is reversed, so that the slave member 181 then is brought to make a snap, clockwise pivoting movement, ending at limiting stop 189, it is further retained at said position by a magnetic locking action, produced by the magnetic attraction between the first driver member 180 and the surface of the magnet member 183. The said reverse movement of the slave member 181 described the switch's other stable actuated position, not shown.

FIG. 19 represents a momentary snap-action switch with a simple assembly, wherein the driver member is formed of a magnet assembly 200, comprising a permanent magnet member 201, provided with a U-shaped armature 202, having a long flange 203 and a short flange 204, the latter arranged to extend one of the magnet's magnetic poles to cooperate magnetically with the magnet's other pole, on the magnet's exposed surface, resulting in a strong combined North and South attracting force along the magnet's exposed surface. A slave member 205, made of a magnetic material such as a nickel alloy or equivalent, is provided with a free end appropriately plated so as to provide a conducting surface 206. Opposite said free end, the slave member 205 is provided with a hingeable end, having a round cross-section 207. Said slave member is arranged to be magnetically locked onto the operative, exposed surface of the magnet member 201, so as to have the short flange 204 of armature 202 in contact with the top surface of slave member 205, along an edge 208, in parallel with the hingeable end 207. An actuating knob 211 is attached atop armature 202. A plastic extruded channel having a generally U-shaped cross section forms a supporting housing 209. As seen in cross section, said housing 209 is provided with a contiuous groove 210 on one wall and further provided with a defined inside edge 212 where the base meets the opposite wall, the latter being terminated at its top by a retaining flange 213. The inside vertical space provided by housing 209 is designed so as to accomodate the height of the armature's long flange 203. The assembled, magnetically locked combination of driver member 200 and slave member 205 are inserted into housing 209 with a slide fit, and arranged in such manner so as to align the armature's long flange 203 with the housing's inside edge 212. An actuating force 214, applied onto actuating knob 211 will cause armature 202 to be hinged along the bottom edge of its long flange 203, further causing the armature's short flange 204 to bear onto the slave member 205, resulting in the latter being rapidly separated from its first, magnetically locked position and be moved, with a hinged movement, towards its second actuated position, wherein the free end 206 of said slave member 205 makes a shunting contact with two contacts 215 and 216, closing a electric circuit. This type of assembly, within an extruded channel, permits the arrangement of a multitude of switches in a keyboard installation. FIG. 19 illustrates the momentary switch assembly in the actuated mode.

FIGS. 20 and 21 represent the same push-button-switch shown in FIGS. 12 and 13, but in combination with a solid-state sensor, such as a Hall-generator, or others dependent on the controllable presence of a magnetic field. In FIG. 20, a Hall-sensor 900 is arranged at the base of the housing, outside the actuating magnetic field of the movable permanent magnet member 901. Said permanent magnet member is chosen to have two operative magnetic surfaces 92 and 902, the first magnetic surface providing a magnetic field of attraction and is arranged to be facing the movable slave member 91 and the second magnetic surface 902, arranged to have the appropriate magnetic pole required to actuate the Hall-generator 900. FIG. 21 shows the magnet member 901 in its second, displaced position, facing the Hall-generator 900, while the slave member 91 has been actuated, and is shown in its second, actuated position. Both solid-state actuation and the slave member's break-and-make actuation can be programmed either to be coincident or in a chosen sequence. The tactile and/or audible feedback produced by the actuation of the slave member additionally confirms the actuation of the solid-state sensor.

FIGS. 22 and 23 represent yet another momentary actuation of a switch, with the addition of a pre-travel movement, preceding a snap-action. In FIG. 22, the embodiment shows a switch at rest, wherein a housing 405 made of non-magnetic material, provided with constraining walls 404 and guiding tracks 402 at its open top, provides support and guidance for vertical movement, within predetermined limits, defining the upper limit by the constraining walls 404. A driver member 401 performing like a plunger, having an actuating knob 400 at its top and two bearing edges at its base, a first bearing edge 406, chosen at a predetermined distance from the top of the knob 400, and said driver member having a second bearing edge 421, arranged at a further distance away from the top of said knob 400. Arranged between the two said bearing edges and protruding vertically downward from the base of driver member 401 is a permanent magnet member 409, having a first magnetic surface 410 and a second magnetic surface 417. A first slave member 408 and a second slave member 418, both made of a magnetic material such as soft iron, and generally L-shaped, each having its short leg end-in at a pivot, and its long leg free ending. Both said slave members are arranged for free pivotal movement, within predetermined paths. First slave member 408 is arranged for movement around fixed pivot 407, and its free end is limited for travel between limiting positions 413 and 411, whereas second slave member 418 is arranged for movement around fixed pivot 420, and its free end is limited for travel between limiring positions 414 and 416. Said limiting stops 413 and 414, at the base of the housing, are arranged in such manner as to prevent said first and second slave members, from a friction-causing surface-to-surface contact with the respective surfaces 410 and 417 of the magnet member 409. Magnetic attraction between said magnet member 409 and slave members 408 and 418 holds the latter two members firmly locked against their respective limiting stops, or contacts, 413 and 414, respectively, allowing for a small air gap along each of the magnet member's surfaces 410 and 417. In this first locked position of the switch, the driver member's bearing edge 421 is in contact with the short leg of second slave member 418, at a distance 419 from pivot 420. Whereas the driver member's first bearing edge 406 lies above first slave member 408, and at a projected distance 422 from pivot 407, said distance 422 being taken radially, along the short portion of first slave member 408. Furthermore, taken with respect to distance 419, said distance 422 is chosen to be relatively much smaller. As previously explained in the basic movement represented in FIGS. 1,2 and 3, the longer the distance allowing for a certain leverage, the slower the pivotal movement of the slave member. In FIG. 23, the driver member 401 has been partially pushed down vertically, and is shown at the end of its slow, pre-travel movement, and at the start of a snap action movement, which follows any further downward movement of the actuating knob 400. In the position shown in FIG. 23, the knob 400 may be released before a snap-action is initiated. When an actuating force is removed, second slave member 418 will be magnetically forced back to its first locked position, as shown in FIG. 22, and in doing so it will cause the driver member's second bearing edge 421 to be pushed vertically upwards, in essence, moving the driver member 401 back to a limiting stop formed by the housing's constraining walls 404, against the driver member's slanted walls 403. Modifications of this assembly would produce other modes of actuation when the relationship between the respective bearing edges and associated slave members are rearranged. The number of slave members is furthermore not limited to just two.

FIG. 24 represents an embodiment of a pressure sensitive triggering switch, with a bi-stable movement, wherein a housing 513 with an opening at its top permitting access to a rocker-type actuating knob 500, pivoted at 501, and allowed free movement in a predetermined path between a first and second stable position. A permanent magnet assembly comprising a permanent magnet member 502, magnetized with a single pole on each of its two surfaces and designated South for its bottom surface, in this drawing, and North on the upper surface, the latter being attached to an armature 503, having a short flange on the right side of the magnet member arranged in such manner as to provide a North magnetic pole on the same plane as that of the magnet member's South pole. Said armature 503 also extends beyond the magnet, on the opposite extremity with respect to the flange, thereby extending the magnet's North pole further to the left of the magnet member 502, whose South pole surface is provided with a bearing edge 515. A slave member 504, made of a magnetic material such as soft iron, is allowed free pivotal movement around fixed pivot 505, and is provided with a long arm arranged to bridge both South and North poles provided by the lower surface of the magnet member and the flanged portion of the armature 503. The said slave member 504 is further provided with a short arm 509, angled downward, with respect to the long arm 504, said angle being chosen so as to allow said short arm to be brought to a face-to-face contact with the trailing portion of the magnet member's armature 503. The latter being magnetized with a polarity indicating North, and the slave member's angled portion 509 having acquired a South pole as a result of being in contact with the magnet member's South pole surface, via the magnet's bearing edge 515, in effect the two surfaces being in face-to-face contact are caused to be of opposite magnetic polarity and will consequently remain in a stable magnetically locked position, as indicated in FIG. 24. This assembly is designed in such manner that when a slight actuating force is applied to the actuating knob 500, on the right side of pivot 501, the magnetic lock provided at the left of pivot 505 is quickly released, and both driver member 500 and slave member 504 will snap to a second, magnetically locked position, in which the long arm of driver member 504 is very strongly attracted by the South pole and extended North pole of the magnet member 502. The difference between this release actuation, causing a snap-action and any other rocking movement of an actuating knob, is that in the case of this embodiment, the releasing force is momentarily applied. It does not have to be sustained until the switch reaches its second stable position. In FIG. 24, contacts 507 and 508 are shown shunted by a shunting contact member 506, at the free end of the driver member's long arm 504, whereas contact member 510, at the end of the slave member's short arm 509 is in the open, break, position with respect to limiting contact 511. A ledge 514, on the inside wall of housing 513 provides a stop for the actuating knob 500, limiting any overtravel at the end of the return, snap-movement.

FIG. 25 represents an embodiment of a rotary switch with a different bi-stable actuation, wherein the driver member 600 is a cylinder with a circular cross section and is rotatable counter-clockwise around a central shaft 601, and is further provided with a circular periphery 602. The surface of said periphery 602 is made of a magnetic material such as soft iron, and is provided with three grooves 603, 604 and 605, not equally spaced around said periphery 602. Three slave members 606,607, and 608, all three are equally shaped and comprise a support member 609, onto which a segment of a ring magnet 610 is attached, said segment having an inside periphery with a curvature generally matching the driver member's outer periphery 602. Said support member is provided with a free end and a pivoted end, in addition to a short flange 611, shaped to provide a bearing surface when brought into contact with the driver member's rotating peripheral surface. The pivoting portion of said support member 609 is located, as measured radially from the central shaft 601, further away than the said bearing surface on the short flange 611. the three slave members 606,607 and 608 are arranged for free pivotal movement around three respective pivots 612,613 and 614, said pivots being located equidistantly as measured from the central shaft 601, but not equidistantly around the system's periphery. Two of the said slave members 606 and 607 are arranged, together with their respective pivots 612 and 613, in such manner with respect to the said cylinder's periphery 602, that the grooves 603 and 604 accomodate the protruding flanges 611 of said slave members 606 and 607. The third slave member 608, together with its pivot 614 are arranged with respect to the driver member 600 in such manner that the bearing surface on short flange 611 of the third slave member 608 is outside the third groove 605, and in contact with the cylinder's circular periphery 602. The third slave member will therefore be caused to pivot away from the surface of the the driver member's periphery 602 and will be moved to a second actuated position identified at 620 for the third slave member, and said second limiting positions are identified at 618 and 619 for the first and second slave members 606 and 607 respectively. When the driver member 600 is rotated in a counter-clockwise direction, the first and second slave members 606 and 607 will be pivoted away to their second positions with a snap-action, while the third slave member 608 will also maintain its actuated position until a groove is brought opposite a flange 611 of any of the slave members. The assembly shown in FIG. 25 represents only one plane or cross section of what could be a driver member in the shape of a drum, having multitudes of slave members in successive planes. This drawing does not exclude embodiments having different quantitative groupings of unequal numbers of grooves and slave members nor different locations for pivots, with respect to grooves.

Figure 26:
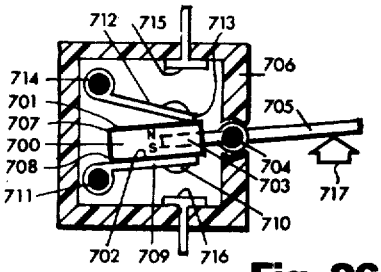
Figure 27:
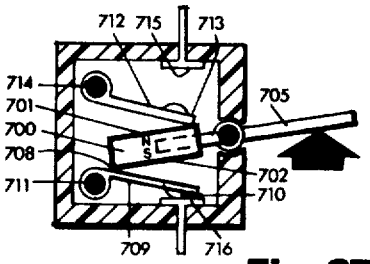
Figure 28:
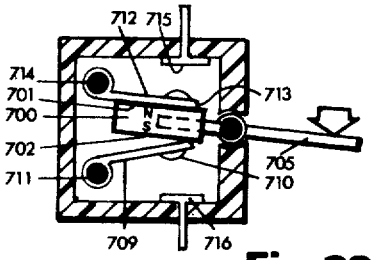
Figure 29:
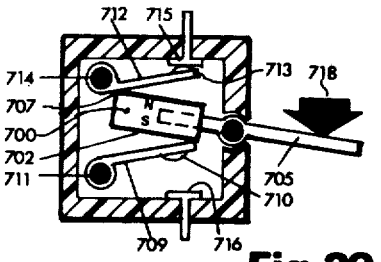

FIGS. 26 to 29 represent an embodiment of a toggle switch providing two bi-stable positions flanked by a momentary position on each side. In drawing 26, representing the first of two bi-stable positions, a permanent magnet member 700, provided with magnetic surfaces 701 and 702 respectively terminating at bearing edges 707 and 708, is supported by a movable shaft 703, arranged for free pivotal movement around a fixed pivot 704, in turn supported by a housing 706, made of a non magnetic material. Movable shaft 703 is extended beyond said housing so as to form an actuating lever 705. A first slave member 709, having a free end provided with a contact 710 and a pivoted end, is made of a magnetic material such as soft iron. Said second slave member 709 is allowed free pivotal movement, and is arranged to be in surface-to-surface contact with magnetic surface 702 of magnet member 700 in such manner that the magnet member's bearing edge 708 lies ahead of fixed pivot 711. This arrangement of the magnet member 700 and first slave member 709 form the basic assembly shown in FIGS. 1 and 2. A second slave member 712, equally made of the same magnetic material is arranged to be pivoted at 714, equidistantly located with respect to the magnet member's pivot 704 as is the first slave member's pivot 711. Pivots 714 and 711 are spaced apart at a distance exceeding the distance between the magnet member's surfaces 701 and 702. Second slave member will be attracted at its free end 713 by the magnet member's surface 701, thereby maintaining an open contact between limiting contact 715 and the second slave member's contact at its free end 713, as indicated in FIG. 26, representing the first of two bi-stable positions. According to the basic movement of this invention, an actuating force 717, applied to the lever 705 counter-clockwise, will cause the first slave member 709 to be moved with a snap-action, onto limiting contact 716, thereby closing contacts 716 and 710, as indicated in FIG. 27, and representing the first momentarily actuated position of this 4-position switch. When the actuating force 717 is removed, the movable members will return to the position represented in FIG. 26. Starting from FIG. 26, when an actuating force is applied to lever 705 in a clockwise direction, the magnet member's magnetic surface 701 will first reach a position wherein it will be in face-to-face contact with the surface of the second slave member 712. The magnetic attraction between the magnet member's other magnetic surface 702 and the first slave member 709 will cause the latter's free end 710 to remain attracted to the magnet member in this and subsequent clockwise movements of the actuating lever 705, thereby maintaining contacts 710 and 716 in the open position. The movement just described is represented in FIG. 28, and represents the second bi-stable position of the switch. FIG. 29 represents a second momentary actuation and the last of the four switching positions, wherein a further actuating force 718 is applied in a clockwise direction, the second slave member 712 snaps to a momentarily actuated position, thereby closing contacts 713 and 715, while contacts 710 and 716 remain open, as indicated in FIG. 29. In the assembly of this switch, a modification of the location of the two slave members' respective pivots 711 and 714, arranging the latter so that the distance between them allows both said slave members 709 and 712 to be in surface-to-surface contact with the permanent magnet's respective magnetic surfaces 702 and 701, simultaneously, such an arrangement of movable members with respect to each other will produce a double momentary switch, with a single stable, central position. In said modified assembly, limiting contacts 715 and 716 will also have to be modified with respect to their relocation.

FIG. 30 represents an embodiment of a momentary switch wherein a row of contacts are actuated simultaneously. The assembly uses magnet members with integrally moulded conducting strips or ribbons as well as surface contacts and associated terminal pins. The magnet members, as indicated in the exploded view, are chosen to be magnetized on their operative surfaces with alternating North and South poles, in order to make said magnetic members self-aligning in a desired position, during assembly operations. In the drawing, a driver member 800, made of a rigid plastic-bonded material, and magnetized only on its bottom surface with a grid of alternating North and South poles, is provided with an actuating knob 801, and further provided on a side opposite the said knob 801, on the magnetic surface, with a row of ribbon, conducting strips, one of which is indicated at 802. Said strips 802 are provided with V-shaped notches, collectively forming a continuous groove with conducting, wiping surfaces 804, running along the width of the driver member 800. A slave member 805, equally made of a rigid plastic-bonded magnetic material, is magnetized on its top surface with a grid of North and South magnetic poles, chosen with respect to their orientation, to attract their counterpart magnetic poles on the underside of the driver member 800. Said slave member 805 is further provided with a row of ribbon, conducting strips, shown partially at 807, starting at the top surface and wrapping around onto the full length of the underside surface, at 806 and providing a V-shaped groove at 808, with successive ribbon strips providing a multitude of wiping contacts 809, along said groove. The spacing and orientation of said strips of ribbon conductors provided on both the driver member 800 and the slave member 805 is such that said driver and slave members are operatively engaged, and the top portion of ribbon contact 807 is touching the forward portion of ribbon contact 802, when the driver member 800 and the slave member 805 are locked magnetically in a face-to-face surface contact. A base plate 810, made of a non-magnetic material, is provided with a first ridge 811, supporting a row of conducting ribbon contacts, 812,813, shaped and spaced to cooperate with the row of contacts and associated groove 804, on the driver member 800. The said base plate 810 is further provide with a second ridge 815, supporting a row of ribbon conductors or contacts 816, with integral terminals 817. Said ridge 815 and associated contacts 816 are arranged to cooperate operationally with counterpart groove 808 and associated contacts 809, when the said base plate 810, together with slave member 805 and magnetically locked driver member 800 are stacked together. When the said members are assembled, the slave member 805 is in its first locked position. And when the driver member 800 is subjected to an actuating force, bearing down onto knob 801, said force will be transmitted through a bearing edge 818, on said driver member 800, and bear down onto a bearing surface 819, on the surface of slave member 805, causing the latter to be pivoted along the cooperating groove 808 and corresponding ridge 815, such pivoting movement resulting in the slave member's snap movement to its second, actuated position wherein the row of contacts 806 engage corresponding contacts 820,821 of an optional plug-in integrated circuit unit 822, with associated terminal contacts 823. The flow of a current would follow a path starting at contact terminal 814, to ridge contact 812, providing a wiping contact at 804, to a magnetically locked surface contact between 802 and 807, along 806, on to groove 808, providing a wiping contact with ridge contact 816 and out via contact terminal 817. This path is followed when the switch is not actuated. In the actuated mode, the flow would be from contact terminal 823, through the integrated circuit, then out to contact 820, onto a surface contact with 806, then along 806 to groove 808 where it provides a wiping contact with ridge contact 816, and out contact terminal 817.

Various changes may be made to the scope of the invention beyond the specific embodiments illustrated. Many different embodiments may be made, incorporating the movement of the present invention, which is limited only by the scope of the claims.

The embodiments of the invention in which an exclusive property or privilege is claimed are defined as follows:

1. A magnetic switch comprising:

a. a switch mounting structure, b. a first driver member comprising:

1. a first mounting portion by which said first member is moveably mounted relative to said switch structure,
2. a first magnetically attractive portion having a first magnetically attractive surface portion,
3. a first bearing portion, c. mounting means, attached to said switch structure, providing support for the movement of said first member, d. a second slave member comprising:
1. a second mounting portion by which said second member is moveably mounted relative to said switch structure,
2. a second magnetically attractive portion having a second magnetically attractive surface portion,
3. a second bearing portion, e. first pivot means, attached to said switch structure, providing support for the movement of said second member, f. first stop means, mounted to said switch structure, located in the path of travel of said second member, g. said first and second members having a first position where the first and second magnetically attractive surface portions are located adjacent one another in a manner to cause said first and second members to be magnetically held in said first position, said first and second members also having a second position, h. said first member being moveable by an applied force to said second position in a manner causing the said first bearing portion to engage the said second bearing portion, the resulting engaged movement further causing a corresponding movement of said second member to said second position wherein said second member makes contact with said first stop means, said engaged movement further causing said first and second magnetically attractive surface portions to become spaced from one another by an air gap, i. at least one of said first and second members being mounted for angular movement relative to said switch structure in a manner that said first and second members move angularly relative to one another.

2. The switch as recited in claim 1, wherein said second slave member is pivotally mounted for rotational movement.

3. The switch as recited in claim 1, wherein said first member is mounted for rotational movement about a first pivot location, and said second member is mounted for rotation about a second pivot location.

4. The switch as recited in claim 3, wherein said first and second members are arranged so that rotational movement of said first member to said second position causes an opposite rotational movement of said second member to said second position.

5. The switch as recited in claim 3, wherein said first and second members are so mounted that rotational movement of said first member to said second position causes a corresponding rotational movement of said second member to said second position in a direction which is the same as that in which the first member was moved.

6. The switch as recited in claim 3, wherein said first and second bearing portions are located intermediate said first and second pivot locations, and said first and second magnetically attractive surface portions are also located intermediate said first and second pivot locations, with said first and second members rotating oppositely of one another to move to said second position.

7. The switch as recited in claim 3, wherein said first and second pivot locations are positioned on one side of said switch, said first and second bearing portions and said first and second magnetically attractive surface portions are located on an opposite side of said switch, with said first and second members rotating in the same direction to said second position.

8. The switch as recited in claim 1, wherein said first driver member has a third magnetically attractive surface portion and a third bearing portion; there is a third slave member having a fourth magnetically attractive surface portion and a fourth bearing portion; there also is a second stop means; in said first position, said third member is located so that said third and fourth magnetically attractive surface portions are located adjacent one another in a manner to cause said third and first members to be magnetically held to one another in said first position; said third member is arranged to be moveable to said second position, with said third bearing portion engaging said fourth bearing portion to cause a corresponding movement of said third member to said second position wherein said third member makes contact with said second stop means; said third member being mounted for angular movement relative to said first member so that, in said second position, said third and fourth magnetically attractive surface portions become spaced from one another by an air gap.

9. The switch as recited in claim 8, wherein said first member is rotatably mounted about a first pivot location, and said second and third members are rotatably mounted about second and third pivot locations, respectfully.

10. The switch as recited in claim 9, wherein said second and third slave members are mounted for rotation in the same direction for movement from said first position to said second position, with said first driver member being mounted for rotation in an opposite direction to that of said second and third members during movement from said first position to said second position.

11. The switch as recited in claim 1, wherein said first driver member has a third magnetically attractive surface portion and a third bearing portion; there is a third slave member having a fourth magnetically attractive surface portion and a fourth bearing portion; said switch is further provided with second stop means; in said second position, said third member is positioned in such manner that said third and fourth magnetically attractive surface portions are located adjacent one another in a manner to cause said third and first members to be magnetically held to one another; said third member is further arranged to be movable from said second position to said first position; with a second actuating force applied to said first member in a direction opposite that of the initial applied force, said third bearing portion being moved to engage said fourth bearing portion to cause a corresponding movement of said third member to said first position, wherein said third member makes contact with said second stop means; with said third member being mounted for angular movement relative to said first member, in said first position said third and fourth magnetically attractive surface portions become spaced from one another by an air gap; the alternating magnetic hold between said first member and each of said second and third members causing a corresponding maintained contact between said second member and said first stop means in a first switching position, and alternately further causing a maintained contact between said third member and said second stop means in a second switching position; said switch thereby providing an alternatig switching movement held in place in each of said first and second positions.

12. The switch as recited in claim 11, wherein said second and third slave members are so arranged that as said first member is moved from said second to said first position, said second member rotates to said second position in a first direction, and as said first member is rotated back to its first position, said third member is caused to rotate to said first position in a direction opposite to said first direction.

13. The switch as recited in claim 11, wherein said first member is mounted for rotation about a first pivot location positioned intermediate said first and third magnetically attractive surface portions, said second member is pivotally mounted at a pivot location positioned on one side of said first member, and said third member is pivotally mounted at a pivot location at an opposite side of said first member, said switch being further arranged so that movement of said first member from the first to the second position causes movement of said second member in a first direction of rotation, and movement of said first member from said second position to said first position causes rotational movement of said third member in a rotational direction opposite to that of the second member.

14. The switch as recited in claim 1, wherein said first driver member is mounted for linear travel, and said second slave member is pivotally mounted for rotational movement; said switch being characterized in that linear travel of said first member causes said first bearing portion to engage said second bearing portion to cause rotational movement of said second member to said second position, wherein said second member engages said first stop means.

15. The switch as recited in claim 14, wherein said switch is so arranged that linear travel of said first member in a first direction causes movement of said second member in a curved path having a substantial component of movement generally perpendicular to the linear travel of the first member.

16. The switch as recited in claim 15, wherein said second member has its second magnetically attractive portion and its second magnetically attractive surface portion generally aligned with said linear travel of the first member, and the second mounting portion of the second member extends to a pivot location of said second member along a line having a substantial perpendicular component to the linear travel of said first member.

17. The switch as recited in claim 16, further comprising sensor means located magnetically proximate the first path of travel of said first member, said sensor means being responsive to magnetic actuation by said first member, whereby movement of said first member from its first to its second position, in addition to causing movement of said second member, causes actuation of said sensor means.

18. The switch as recited in claim 14, further comprising solid-state switching sensor means located proximate the path of travel of said first member, said sensor means being responsive to actuation by said first member, whereby movement of said first member from its first to its second position, in addition to causing movement of said second member, causes a reactive respone in said sensor means.

19. The switch as recited in claim 14, wherein said first driver member has a third magnetically attractive surface portion and a third bearing portion; there is a third slave member having a fourth magnetically attractive surface portion and a fourth bearing portion; the switch is further provided with second stop means located in the path of travel of said second member, and third and fourth stop means located in the path of travel of said third member; in said first position, the magnetic hold between said first member and said second member also provides a maintained engagement between said second member and said second stop means, and in said first position, said third member is located so that third and fourth magnetically attractive surface portions are located adjacent one another in a manner to cause said first and third members to be magnetically held to one another and further to cause said third member to be in maintained engagement with said fourth stop means; said third member being pivotally mounted for angular movement relative to said first member and being further arranged to be moveable to said second position, with said first member being moved to the second position, said third bearing portion engaging said fourth bearing portion to cause a corresponding movement of said third member to said second position, so that said third and fourth magnetically attractive surface portions become spaced from one another by an air gap, so that in its movement from said first to said second position, said third member first disengages from said fourth stop means and proceeds to engage said third stop means.

20. The switch as recited in claim 19, wherein the first and third bearing portions of the first member are so arranged relative to the second and fourth bearing portions of the second and third members, respectively, that in movement of said first member from the first to the second position, said first and second bearing portions come into engagement prior to said third and fourth bearing portions coming into engagement, so that said second member is moved rotationally to cause the first and second magnetically attractive surface portions to become spaced from one another prior to engagement of said third bearing portion with said fourth bearing portion causing rotational movement of said third member, whereby said third and fourth magnetically attractive surface portions become spaced from one another by an air gap, so that said switch operates sequentially, whereby said second member disengages from said second stop means prior to said third member disengaging from said fourth stop means.

21. The switch as recited in claim 20, wherein said switch is so arranged that linear travel of said first member in a first direction causes movement of said second member and said third member in respective curved paths, each path having a substantial component of movement generally perpendicular to the linear travel of the first member.

22. The switch as recited in claim 21, wherein said second member has its second magnetically attractive surface portion generally aligned with said linear travel of the first member, and the second mounting portion of the second member extends to a first pivot location of said second member along a first line having a substantial perpendicular component to the linear travel of said first member, said third member has its fourth magnetically attractive surface portion generally aligned with said linear travel of the first member, and a third mounting portion of the third member extends to a second pivot location of said third member along a line having a substantial perpendicular component to the linear travel of said first member.

23. The switch as recited in claim 20, wherein said switch is so arranged that linear travel of said first member in a first direction causes movement of said second member and said third member in respective curved paths, each path having a substantial component of movement generally perpendicular to the linear travel of the first member.

24. The switch as recited in claim 23, wherein said second member has its second magnetically attractive surface portion generally aligned with said linear travel of the first member, and the second mounting portion of the second member extends to a first pivot location of said second member along a first line having a substantial perpendicular component to the linear travel of said first member, said third member has its fourth magnetically attractive surface portion generally aligned with said linear travel of the first member, and the third mounting portion of the third member extends to a second pivot location of said third member along a second line having a substantial perpendicular component to the linear travel of said first member.

25. The switch as recited in claim 14, wherein said first driver member has a third magnetically attractive surface portion and a third bearing portion; there is a third slave member having a fourth magnetically attractive surface portion and a fourth bearing portion; said switch is further provided with a second stop means; in said second position, said third member is positioned in such manner that said third and fourth magnetically attractive surface portions are located adjacent one another in a manner to cause said third and first members to be magnetically held to one another; said third member being mounted for angular movement, relative to said first member, and further arranged to be moveable from said second position to the first position, with a second force applied to the first member reversing its movement from said second to the first position, said third bearing portion is brought to engage said 4th bearing portion to cause a corresponding movement of said 3rd member to said first position, wherein said third and fourth magnetically attractive surface portions become spaced from one another by an air gap, so that in said first position, said third member makes contact with said second stop means; in said second position, the magnetic hold between said first and third members causes a correspondingly maintained engagement between said second member and said first stop means; and alternately in said first position, the magnetic hold between said first and second members causes a correspondingly maintained engagement between said third member and said second stop means; said switch thereby providing a reciprocating switching movement held in place in each of said first and second positions.

26. The switch as recited in claim 25, wherein said switch is so arranged that linear travel of said first member in a first direction causes movement of said second member in a first curved path having a substantial component of movement generally perpendicular to the linear travel of the first member, and linear travel of said first member in a second direction causes movement of said third member in a second curved path having a substantial component of travel generally perpendicular to the linear travel of the first member in the second direction.

27. The switch as recited in claim 26, wherein said second member has its second magnetically attractive surface portion generally aligned with said linear travel of the first member, and the second mounting portion of the second member extends to a first pivot location of said second member along a first line having a substantial component perpendicular to the linear travel of said first member.

28. The switch as recited in claim 1, wherein said second slave member has a third magnetically attractive surface portion and a third bearing portion; there is a third driver member having a fourth magnetically attractive surface portion and a fourth bearing portion; there is a second stop means; in said second position, said third driver member is positioned in such manner that said third and fourth magnetically attractive surface portions are located adjacent one another in a manner to cause said third and second members to be magnetically held to one another; said third driver member being mounted for angular movement, relative to said second member, and further arranged to be moveable from said second position to the first position, with a second force applied to said third driver member reversing its movement from said second to the first position, said fourth bearing portion is brought to engage said third bearing portion to cause a corresponding movement of said second member to said first position, wherein said third and fourth magnetically attractive surface portions become spaced from one another by an air gap, so that in said first position said second member makes contact with said second stop means; in the 2nd position, the magnetic hold between said third and second members causes a correspondingly maintained engagement between said second member and said first stop means; and alternately in said first position, the magnetic hold between said first and second members causes a correspondingly maintained engagement between said second member and said second stop means; said switch thereby providing an alternating swtiching movement held in place in each of said first and second positions.

29. The switch as recited in claim 28, wherein said second slave member is mounted for rotation about a second pivot location positioned intermediate said second and third magnetically attractive surface portions, said first driver member is pivotally mounted at a first pivot location positioned on one side of said second member, and said third driver member is pivotally mounted at a third pivot location at an opposite side of said second member, said switch being further arranged so that movement of said first member from the first position to the second position causes movement of said second member in a first direction of rotation, and movement of said third driver member from said second position to said first position causes rotational movement of said second member in a rotational direction opposite said first direction of rotation.

30. The switch as recited in claim 1, wherein said first member is mounted for rotational movement about a first pivot location, and said second member is mounted for rotation about a second pivot location.

31. The switch as recited in claim 30, wherein said first and second members are arranged so that rotational movement of said first member to said second member to said second position.

32. The switch as recited in claim 30, wherein said first and second members are so mounted that rotational movement of said first member to said second position causes a corresponding rotational movement of said second member to said second position in a direction which is the same as that in which the first member moves.

33. The switch as recited in claim 30, wherein said first and second bearing portions are located intermediate said first and second pivot locations, and said first and second magnetically attractive surface portions are also located intermediate said first and second pivot locations, with said first and second members rotating oppositely of one another to move to said second position.

34. The switch as recited in claim 1, wherein said first driver member is mounted for linear travel, and said second slave member is pivotally mounted for rotational movement; said switch being characterized in that linear travel of said first member towards said second member causes said first bearing portion to engage said second bearing portion to cause rotational movement of said second member to said second position, wherein said second member makes contact with said first stop means.

35. The switch as recited in claim 34, wherein said switch is so arranged that linear travel of said first member in a first direction causes movement of said second member in a curved path having a substantial component of movement generally perpendicular to the linear travel of the first member.

36. The switch as recited in claim 1, wherein said first driver member is mounted for linear travel, and said second member is pivotally mounted for rotational movement about a pivot location, said first and second magnetically attractive surface portions being positioned in a plane extending transversely to a path of linear travel of said first member moving from its first to its second position, whereby when said first member travels from its first to its second position, said second magnetically attractive surface portion is moved away from said first magnetically attractive surface portion in a direction having a substantial component of travel parallel to the linear travel of the first member.

37. The switch as recited in claim 1, wherein said switch structure has mounting means comprising a second pivot portion arranged to engage said first mounting portion of said first driver member; said switch structure further comprising a first pivot portion arranged to engage said second mounting portion of said second slave member; said first and second members are arranged in such manner, relative to said switch structure, that movement of said first member produces a wiping engagement between said first mounting portion and said second pivot portion, and movement of said second member produces a wiping engagement between said second mounting portion and said first pivot portion, and movement of said second member to the second position causes said second member to engage said first stop means.

38. The switch as recited in claim 37, wherein said second mounting portion comprises a first conductive contact portion arranged to engage a corresponding second conductive contact portion provided on said first pivot portion; said second member being further provided with a third conductive contact portion extending said first conductive contact portion to a first location on said second member identified as that at which said second member engages said first stop means; said first stop means comprising a fourth conductive contact portion.

39. The switch as recited in claim 38, wherein said second member is provided with a fifth conductive contact portion extending said first conductive contact portion to a further second location adjacent the second magnetically attractive surface portion of said second member; said switch further comprising a first driver member provided with a first mounting portion comprising a sixth conductive contact portion arranged to engage a corresponding seventh conductive contact portion provided on said second pivot portion; said first member being further provided with an eighth conductive contact portion extending said sixth conductive contact portion to a location adjacent said first magnetically attractive surface portion of said first driver member; said first and second members are arranged, relative to one another and relative to said switch structure, in such manner that, in the first position, said first and second members are magnetically held to one another and said magnetic hold further provides a maintained engagement between said eighth and fifth conductive contact portions, so that, in combination with said first and second pivot portions, said arrangement would provide a continuous current flow from said second conductive contact portion through to said seventh conductive contact portion; and in said second switching position, said current flow would be from said second conductive contact portion through to said fourth conductive contact portion.

40. The switch as recited in claim 39, wherein each of said first through eighth conductive contact portions comprises a plurality of conductive contact portions, each set of said plurality of conductive contact portions arranged to engage a corresponding set of a plurality of conductive contacts, whereby said switch provides simultaneous switching of a plurality of circuits.

41. The switch as recited in claim 1, wherein said second slave member is pivotally mounted for rotation about a first pivot location, said second member having a retaining portion having a third magnetically attractive surface portion, said first member having a fourth magnetically attractive surface portion, said third and fourth magnetically attractive surface portions being so positioned that with said switch in its second position, said third and fourth magnetically attractive surface portions are in magnetic engagement with one another so as to hold said first and second members in the second position.

42. The switch as recited in claim 41, wherein said first member is mounted for rotation about a second pivot location, said first and second members being so arranged that rotational movement of the first member towards the second member causes the first bearing portion to engage the second bearing portion thereby causing said second member to be moved in an opposite rotational movement, whereby said first and second magnetically attractive surface portions become separated by an air gap, said movement of said second member further causes said third and fourth magnetically attractive surface portions to become magnetically attracted to one another, thereby holding said first and second members in said second position, said magnetic hold further causes a maintained engagement between said second member and a first stop means.

43. The switch as recited in claim 42, wherein said second member has a first conductive contact portion, located on one side of said first pivot means, and arranged to engage conductive contact portions forming said first stop means, when said second member is in the second position; said second member is also provided with a second conductive contact portion, located on an opposite side of said first pivot means and arranged to engage a conductive contact portion forming a second stop means, when said second member is in the first position; there is a third conductive contact portion, on said second member, joining said first and second conductive contact portions, and providing a wiping engagement with said first pivot means, said first pivot means being provided with a conductive contact portion; in this arrangement, said switch privides an alternating switching movement held in each of said first and second positions.

44. The switch as recited in claim 1, wherein said first driver member is mounted for rotation about a first center of rotation, said first magnetically attractive surface portion is positioned in a curve having a center of curvature generally coinciding with said center of rotation, said second magnetically attractive surface portion being contoured in a curve generally coinciding with said first magnetically attractive surface portion, said first and second members being arranged relative to one another so that rotation of said first member, to a position where said first bearing portion engages said second bearing portion, requires a force to be applied to said first member to cause said second member to be moved radially away from said center of rotation, causing said first and second magnetically attractive surface portions to become spaced from one another by an air gap, and further causing said second member to contact said first stop means, said switch is characterized by the second member being held magnetically in its first position, while allowing said first member free rotational movement, in both directions, prior to the engagement between said first and second bearing portions.

45. The switch as recited in claim 1, wherein said second member is mounted for rotation about a second center of rotation spaced radially from said first center of rotation.

46. The switch as recited in claim 45, wherein said second center of rotation is located radially outwardly from the curve of said first magnetically attractive surface portion.

47. The switch as recited in claim 46, wherein the first bearing portion of the first driver member extends radially from said first magnetically attractive surface portion away from said first center of rotation toward said second center of rotation, said first bearing portion being arranged to engage said second bearing portion at a location intermediate said first and second centers of rotation to cause rotational movement of the second slave member.

48. The switch as recited in claim 44, wherein said first driver member has a third magnetically attractive surface portion and a third bearing portion; there is a third slave member having a fourth magnetically attractive surface portion and a fourth bearing portion, said third magnetically attractive surface portion being positioned in a second curve having a center of curvature generally coinciding with the center of curvature of the curve of the first magnetically attractive surface portion, said fourth magnetically attractive surface portion being contoured in a curve generally coinciding with said third magnetically attractive surface portion, said first and third members being arranged relative to one another so that rotation of said first member from the first to the second position causes said third bearing portion to engage said fourth bearing portion to cause a corresponding movement of said third member to said second position, with said third member being mounted for movement radially away from said first center of rotation, so that in said second position said third and fourth magnetically attractive surface portions become spaced from on another by an air gap; said first and third bearing portions of the first member are arranged relative to one another and relative to said second and fourth bearing portions of the second and third members, respectively, in such manner that rotation of said first member in a first direction causes engagement of said first and second bearing portions at an interval differing from that at which said third and fourth bearing portions engage one another, so that said switch provides a sequential movement of said second and said third members to the second position, wherein said second and third members make contact with a first and a second stop means, respectively.

49. The switch as recited in claim 44, wherein said first driver member has a third magnetically attractive surface portion; said second slave member has a fourth magnetically attractive surface portion and a fourth bearing portion; said third magnetically attractive surface portion is positioned in a second curve having a center of curvature generally coinciding with the center of curvature of the curve of the first magnetically attractive surface portion, said fourth magnetically attractive surface portion being contoured in a curve generally coinciding with said third magnetically attractive surface portion, said first and second members being so arranged relative to one another that with said first and second members in said second position, said third and fourth magnetically attractive surface portions are located adjacent one another in a manner to cause said first and second members to be held magnetically in said second position; with said first member moving from said second position to said first position, said third bearing portion engages said fourth bearing portion to cause a corresponding movement of the second member to said first position, in a manner that said fourth magnetically attractive surface portion moves radially outwardly from said first center of rotation away from said third magnetically attractive surface portion, whereby said switch is magnetically held in place in each of said first and second positions.

50. The switch as recited in claim 1, wherein a. said first driver member is mounted for linear travel, and said second slave member is pivotally mounted for rotational movement; said switch being characterized in that linear travel of said first member causes said first bearing portion to engage said second bearing portion to cause rotational movement of said second member to said second position, b. said first driver member having a third magnetically attractive surface portion and a third bearing portion, c. a third slave member having a fourth magnetically attractive surface portion and a fourth bearing portion, d. in said first position said third member being located so that said third and fourth magnetically attractive surface portions are located adjacent to one another in a manner to cause said first and third members to be magnetically held to one another in said first position, e. said third member being arranged to be moveable to said second position with said third bearing portion engaging said fourth bearing portion to cause a corresponding movement of said third member to said second position, so that with said third member being mounted for angular movement relative to said first member, in said second position, said third and fourth magnetically attarctive surface portions are spaced further from one another by an air gap, f. said second member being pivotally mounted at a first pivot location, and said third member being pivotally mounted at a second pivot location, said first bearing portion engaging said second bearing portion at a location closer to said first pivot location to cause relatively fast movement of said second member, said thrd bearing portion engaging said fourth bearing portion at a location spaced further from said second pivot location to cause relatively slower movement of said third member.

51. A magnetic switch comprising:

a. a switch mounting structure, b. a first driver member mounted to said structure and comprising first and second magnetically attractive surface portions spaced from one another, and first and second bearing portions also spaced from one another, c. a second slave member mounted to said structure and having a third magnetically attractive surface portion and a third bearing portion, d. a third slave member mounted to said structure and having a fourth magnetically attractive surface portion and a fourth bearing portion, e. said first, second and third members having a first position where said first and third magnetically attractive surface portions are located adjacent one another in a manner to cause said first and second members to be magnetically held in said first position, with said second and fourth magnetically attractive surface portions being spaced from one another, f. said first, second and third members being so arranged that said first member is moveable by an applied force from said first position to said second position, with the first bearing portion engaging the third bearing portion to cause a corresponding movement of the second member to the second position, with said first and third magnetically attractive surface portion becoming spaced from one another, f. said first, second and third members being so arranged that said first member is moveable by an applied force from said first position to said second position, with the first bearing portion engaging the third bearing portion to cause a corresponding movement of the second member to the second position, with said first and third magnetically attractive surface portions becoming spaced from one another, h. said first member also being moveable by an applied force from said second position to said first position, with said second bearing engaging said fourth bearing portion to cause a corresponding movement of said third member to said first position, with said second and fourth magnetically attractive surface portions becoming spaced from one another.

52. The switch as recited in claim 51, wherein said second and third slave members are so arranged that as said first member moves from said first to said second position, said second member rotates to said second position in a first direction, and as said first member is rotated back to its first position, said third member is caused to rotate to said first position in a direction opposite to said first direction.

53. The switch as recited in claim 51, wherein said first member is mounted for rotation about a first pivot location positioned intermediate said first and second magnetically attractive surface portions, said second member is pivotally mounted at a pivot location positioned on one side of said first member, and said third member is pivotally mounted at a pivot location at an opposite side of said first member, said switch being further arranged so that movement of said first member from the first position to the second position causes movement of said second member in a first direction of rotation, and movement of said first member from said second position to said first position causes rotational movement of said third member in a rotational direction opposite to that of the second member.

54. The switch as recited in claim 51, wherein said first driver member is mounted for linear travel back and forth between said first and second positions, and said second and third slave members are pivotally mounted for rotational movement about second and third pivot locations, respectively, said switch being characterized in that linear travel of said first member from said first position to said second position causes said first bearing portion to engage said third bearing portion to cause rotational movement of said second member to said second position, and linear travel of said first member from said second position to said first position causes rotational movement of said third member to said first position.

55. The switch as recited in claim 54, wherein said switch is so arranged that linear travel of said first member in a first direction causes movement of said second member in a first curved path having a substantial component of movement generally perpendicular to the linear travel of the first member, and linear travel of said first member in a second direction causes movement of said third member in a second curved path having a substantial component of travel generally perpendicular to the linear travel of the first member in the second direction.

56. A magnetic switch comprising:

a. a switch mounting structure, b. a first driver member mounted to said structure and comprising:

1. a first mounting portion by which said first member is moveably mounted relative to a base structure,
2. a first magnetically attractive portion having a first magnetically attractive surface portion,
3. a first bearing portion, c. a second slave member mounted to said structure and comprising:

1. a second mounting portion by which said second member is moveably mounted relative to a base structure,
2. a second magnetically attractive portion having a second magnetically attractive surface portion,
3. a second bearing portion, d. said first driver member being mounted for linear travel back and forth between a first position of said switch and a second position of said switch, said second slave member being pivotally mounted for rotational movement between said first position and said second position, e. said switch being characterized in that in said first position said first and second magnetically attractive surface portions are located adjacent one another in a manner to cause said first and second members to be magnetically held in said first position, said switch being further characterized in that movement of said first member by an applied force from said first to said second position causes said first bearing portion to engage said second bearing portion to cause rotational movement of said second member to said second position, whereby said second magnetically attractive surface portion is moved rotationally away from said first magnetically attractive surface portion.

57. The switch as recited in claim 56, wherein said switch is so arranged that linear travel of said first member in a first direction causes movement of said second member in a curved path having a substantial component of movement generally perpendicular to the linear travel of the first member.

58. The switch as recited in claim 57, wherein said second member has its second magnetically attractive portion and its second magnetically attractive surface portion generally aligned with said linear travel of the first member, and the second mounting portion of the second member extends to a pivot location of said second member along a line having a substantial perpendicular component to the linear travel of said first member.

59. The switch as recited in claim 58, further comprising sensor means located magnetically proximate the first path of travel of said first member, said sensor means being responsive to magnetic actuation by said first member, whereby movement of said first member from its first to its second position, in addition to causing movement of said second member, causes actuation of said sensor means.

60. The switch as recited in claim 56, further comprising a solid state switching sensor means located proximate the first path of travel of said first member, said sensor means being responsive to magnetic actuation by said first member, whereby movement of said first member from its first to its second position, in addition to causing movement of said second member, causes a reactive response in said sensor means.

61. The switch as recited in claim 56, wherein said first and second magnetically attractive surface portions are positioned in a plane extending transversally to a path of linear travel of said first member moving between first and second positions, whereby when said first member travels from its first to its second position, said second magnetically attractive surface portion moves away from said first magnetically attractive surface portion in a direction having a substantial component of travel paralel to the linear travel of the first member.

62. A magnetic switch comprising:

a. a switch mounting structure.

b. a first driver member mounted to said structure for linear travel back and forth between a first position of said switch and a second position of said switch, said first driver member comprising:

1. first and second magnetically attractive surface portions, 2. first and second bearing portions spaced from one another, c. a second slave member mounted to said structure for rotational movement about a first pivot location, said second slave member comprising a third magnetically attractive surface portion and a third bearing portion, d. a third slave member mounted to said structure for rotational movement about a second pivot location, said third slave member comprising a fourth magnetically attractive surface portion and a fourth bearing portion, e. said switch being arranged so that in said first position, said second member is located so that said first and third magnetically attractive surface portions ar located adjacent to one another and said second and fourth magnetically attractive surface portions are located adjacent one another, whereby said second and third members are magnetically held to said first member in said first position, said switch being further arranged so that movement of seid first member by an applied force to said second position causes said first bearing portion to engage said third bearing portion to rotate said second member to said second position whereby said third magnetically attractive surface portion is caused to be spaced from said first magnetically attractive surface portion, and said second bearing member portion engages said fourth bearing member portion to move said third member to the second position, with the whereby said fourth and second magnetically attractive surface portions being are caused to become spaced from one another.

63. The switch as recited in claim 62, wherein the first and third second bearing portions of the first member are so arranged relative to the second third and fourth bearing members portions of the second and third members, respectively, that in movement of said first member from the first to the second position, said first and second third bearing portions come into engagement prior to said third second and fourth bearing portions coming into engagement, so that said second member moves rotationally to move the first and second third magnetically attractice attractive surface portions away from one another prior to movement of said third second bearing member portion moving said third second and fourth magnetically attractive surface portions from one another, said switch thereby operating in a manner to cause a sequential movement of said second and third members, between said first and second positions.

64. The switch as recited in claim 63, wherein said first and third bearing portions engage one another at a first bearing location on said second member spaced closer to further from said first pivot location, and said second and fourth bearing portions engage one another at a bearing location on said third member spaced a greater distance from closer to said second pivot location, whereby movement of said third member is faster than movement of said second member.

65. A magnetic switch comprising:

a. a switch mounting structure, b. a first drive member mounted to said structure for rotation about a first center of rotation for movement between a first position and second position of said switch, said driver member comprising:

1. a first magnetically attractive surface portion positioned in a curve having a center of curvature generally coinciding with said center of rotation,
2. a first bearing portion, c. a second slave member mounted to said structure for movement between said first and second positions, said second slave member comprising:
1. a second magnetically attractive surface portion being contoured in a curve generally coinciding with said first magnetically attractive surface portion,
2. a second bearing portion, d. said first and second members being arranged so that movement of said first member by an applied force from said first to said second position causes said first bearing portion to engage said second bearing portion to move said second member to the second position, with said first and second magnetically attractive surface portions being moved from a position adjacent one another in said first position to a location further away from one another in said second position.

66. The switch as recited in claim 65, wherein said second slave member is mounted for rotation about a second center of rotation spaced radially from said first center of rotation.

67. The switch as recited in claim 66, wherein said second center of rotation is located radially outwardly from the curve of said first magnetically attractive surface portion.

68. The switch as recited in claim 67, wherein the first bearing portion of the first driver member extends radially from said first magnetically attractive surface portion, away from said first center of rotation, said first bearing portion being arranged to engage said second bearing portion at a location intermediate said first and second centers of rotation to cause rotational movement of the second slave member.

69. A magnetic switch comprising:

a. a switch mounting structure, b. a first driver member mounted to said structure for movement between a first position of said switch and a second position of said switch, said first driver member comprising:
1. first and second magnetically attractive surface portions spaced from one another,
2. first bearing means mounted to said first driver member, c. a second slave member mounted to said structure for movement between said first and second positions, said second slave member comprising:
1. third and fourth magnetically attractive surface portions spaced from one another,
2. second bearing means adapted to engage said first bearing means,
3. Third bearing means adapted to engage said first bearing means, d. said first and second members being arranged relative to one another, so that in said first position, said first and third magnetically attractive surface portions are positioned adjacent one another to hold said first and second members in said first position, with said second and fourth magnetically attractive surface portions being spaced from one another, and in said second position, said second and fourth magnetically attractive surface portions are positioned adjacent one another, with said first and third magnetically attractive surface portions being spaced from one another, e. said first and second members being further arranged relative to one another, in a manner that movement of said first member by an applied force from said first position to said second position, causes said first bearing means to engage said second bearing means to move said third magnetically attractive surface portion angularly away from said first magnetically attractive surface portions, and movement of said first member from said second position to said first position, causes said first bearing means to engage said third bearing means to move said fourth magnetically attractive surface portion angularly away from said second magnetically attractive surface portion, whereby said first and second members are magnetically held to one another in either of said first or second positions.

70. The switch as recited in claim 69, wherein said first member is mounted for reciprocating rotational movement about a center of rotation, and said second member is mounted for reciprocating rotational movement about a second center of rotation, said first, second and third bearing means being positioned intermediate said first and second centers of rotation.

71. The switch as recited in claim 70, wherein said first and second magnetically attractive surface portions are positioned on opposite sides of first bearing means, and said third and fourth magnetically attractive surface portions are also positioned on opposite sides of said first bearing means, whereby movement of said first member from said first to second position causes said second member to reciprocate in one direction, rotating oppositely to said first member, and movement of said second member from said second position to said first position causes opposite rotational movement of said second member.

72. The switch as recited in claim 71, wherein said first and second magnetically attractive surface portions lie in a general curve having a center of rotation curvature generally coinciding with said first center of rotation, and said third and fourth magnetically attractive surface portions are curved to correspond to said first and second magnetically attractive surface portions, whereby rotational movement of said first bearing means between said second and third bearing means can be accomplished, while maintaining a magnetic hold between said first and third magnetically attractive surface portions in the first switching position, and between said second and fourth magnetically attractive surface portions in the second switching position, alternately.

* * * * *